United States Patent [19]

Waki et al.

[11] Patent Number: 4,892,803

[45] Date of Patent: Jan. 9, 1990

[54] COLOR IMAGE-FORMING PROCESS COMPRESSING DEVELOPER CONTAINING NO BENZYL ALCOHOL

[75] Inventors: Kokichi Waki; Kazunori Hasebe; Masahiro Asami, all of Kanagawa, Japan

[73] Assignee: Fuji Photo Film Co., Ltd., Kanagawa, Japan

[21] Appl. No.: 107,833

[22] PCT Filed: Jan. 23, 1987

[86] PCT No.: PCT/JP87/00046

§ 371 Date: Sep. 23, 1987

§ 102(e) Date: Sep. 23, 1987

[87] PCT Pub. No.: WO87/04533

PCT Pub. Date: Jul. 30, 1987

[30] Foreign Application Priority Data

Jan. 23, 1986 [JP] Japan ..... 61-13414

[51] Int. Cl.[4] ..... G03C 7/30/7/26

[52] U.S. Cl. ..... 430/380; 430/393; 430/432; 430/434; 430/464; 430/467; 430/567

[58] Field of Search ..... 430/372, 380, 376, 397, 430/464, 467, 432, 434, 567

[56] References Cited

U.S. PATENT DOCUMENTS

| | | | |
|---|---|---|---|
| 3,996,054 | 12/1976 | Satumma et al. | 430/377 |
| 4,035,188 | 7/1977 | Yabata et al. | 430/467 |
| 4,299,914 | 11/1981 | Fujumastu et al. | 430/552 |
| 4,304,844 | 12/1981 | Fujumatsu et al. | 430/552 |
| 4,443,536 | 4/1984 | Lestina | 430/552 |
| 4,461,826 | 7/1984 | Yamashita et al. | 430/505 |
| 4,507,836 | 3/1985 | Matsuzaka et al. | 430/567 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,564,590 | 1/1986 | Saraki et al. | 430/552 |
| 4,565,777 | 1/1986 | Ogawa et al. | 430/552 |
| 4,590,155 | 5/1986 | Klotza | 430/567 |

FOREIGN PATENT DOCUMENTS

| | | |
|---|---|---|
| 211437 | 2/1937 | European Pat. Off. . |
| 0082649 | 6/1983 | European Pat. Off. . |
| 0086074 | 8/1983 | European Pat. Off. . |
| 29461 | 8/1974 | Japan . |
| 52058 | 4/1980 | Japan . |
| 200037 | 12/1982 | Japan . |
| 31334 | 2/1983 | Japan . |
| 42045 | 3/1983 | Japan . |
| 50536 | 3/1983 | Japan . |
| 48755 | 3/1984 | Japan . |
| 174836 | 10/1984 | Japan . |
| 177553 | 10/1984 | Japan . |
| 177554 | 10/1984 | Japan . |
| 177555 | 10/1984 | Japan . |
| 177556 | 10/1984 | Japan . |
| 177557 | 10/1984 | Japan . |
| 178459 | 10/1984 | Japan . |
| 19140 | 1/1985 | Japan . |
| 26338 | 2/1985 | Japan . |
| 26339 | 2/1985 | Japan . |
| 158444 | 8/1985 | Japan . |
| 162256 | 8/1985 | Japan . |
| 172042 | 9/1985 | Japan . |
| 70552 | 4/1986 | Japan . |
| 30250 | 2/1987 | Japan . |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A color image-forming process which comprises developing, after imagewise exposure, a color photographic paper having at least one light-sensitive layer containing a core/shell surface latent image type monodispersed silver halide emulsion containing substantially no silver iodide, having a silver chloride content of up to 80 mol %, and having a silver bromide content in the shell portion lower than in the core portion with a color developer containing substantially no benzyl alcohol.

When the color photographic paper described above is processed, color images having less fog can be obtained with high color density in a short time without using benzyl alcohol as a development accelerator, with the benzyl alcohol causing a pollution problem.

18 Claims, No Drawings

COLOR IMAGE-FORMING PROCESS COMPRESSING DEVELOPER CONTAINING NO BENZYL ALCOHOL

TECHNICAL FIELD

This invention relates to a color image-forming process, and more particularly to a color image-forming process capable of saving the coating amount of silver and capable of performing quick processing.

BACKGROUND ART

For forming color photographic images, three kinds of color forming photographic couplers, namely yellow, magenta, and cyan color forming couplers are contained in light-sensitive silver halide emulsion layers, and the layers are exposed and then processed by a color developer containing a color developing agent. In this development course, the oxidation product of the aromatic primary amine causes coupling reactions with the couplers to give colored dyes and in this case, it is necessary to give color density as high as possible in a limited developing time.

The purpose of obtaining high color density is usually attained by using couplers having a coupling speed as high as possible, by using silver halide emulsions which are liable to be developed and provide large amount of developed silver per unit coating amount, or by using a color developer showing a high developing speed.

For increasing the developing speed of a silver halide emulsion, it can be easily considered to increase the content of silver chloride in the silver halide but the increase of the content of silver chloride causes a faults that the sensitivity is reduced and fog is liable to form. Also, it may be considered to increase the aforesaid content of silver chloride or strengthen the chemical sensitization for increasing the amount of developed silver but in this case also, there is a fault that fog is liable to form. Furthermore, it is a means for quickening the development to reduce the grain size in a silver halide emulsion but such an attempt has a fatal fault that the sensitivity is lowered. Also, a process of using a silver chloride emulsion is described, for example, in unexamined Published Japanese Patent Application Nos. 95345/83, 232342/84, and 19140/85, but there is a problem that the control of the gradation is difficult.

On the other hand, on a color developer, various attempts have hitherto been made for increasing the development. In these attempts, various additives have been investigated for increasing the permeation of a color developing agent into color coupler-dispersed oil drops to accelerate coloring, and in particular, a process of quickening the color development by adding benzyl alcohol to a color developer has been widely used for the processing of color photographic light-sensitive materials, particularly color photographic papers since the process has a high coloring accelerating effect.

However, since benzyl alcohol has low water-solubility, in the case of using benzyl alcohol it is required to use a solvent such as diethylene glycol, triethylene glycol, alkanolamine, etc. However, since the aforesaid compounds including benzyl alcohol give high BOD and COD, which are pollution-giving values, it is preferred not to use benzyl alcohol for the purpose of reducing the pollution load.

Furthermore, even in the case of using the aforesaid solvent, it takes a long period of time to dissolve benzyl alcohol in the solvent and hence for the purpose of reducing the working load for preparing the liquid, it is better not to use benzyl alcohol.

Also, when benzyl alcohol is carried in a bleach bath or a blix bath, which is a post-bath, it causes the formation of leuco dyes of cyan dyes, which results in the reduction of color density. Furthermore, the entrance of benzyl alcohol delays the washing out speed of the developer components, which sometimes gives bad influences on the image storage stability of processed light-sensitive materials. Accordingly, it is better not to use benzyl alcohol in the reasons described above.

A color development has generally been performed in from 3 minutes to 4 minutes but it has been desired to further shorten the processing time with the recent desirement for shortening the time for delivery of finished products and the reduction of laboratory works.

However, in the case of omitting benzyl alcohol which is a coloring accelerator and shortening the developing time, a severe reduction in color density inevitably occurs.

For solving the problems, even when various kinds of color development accelerators (for example, compounds as described in U.S. Pat. Nos. 2,950,970, 2,515,147, 2,496,903, 2,304,925, 4,038,075, and 4,119,462, British Patent Nos. 1,430,998, and 1,445,413, Unexamined Published Japanese Patent Application Nos. 15831/78, 62450/80, 62451/80, 62452/80, and 62453/80, Japanese Patent Publication Nos. 12422/76 and 49728/80) are employed together, sufficient color density has not yet been obtained.

Also, even when techniques of incorporating 3-pyrazolidones (for example, techniques as described in Unexamined Published Japanese Patent Application Nos. 26338/85, 158444/85, and 158446/85) are used, the use of such a technique is accompanied by a disadvantage that the sensitivity is reduced and fog forms in the case of storing the color photographic materials in unexposed state.

Furthermore, even when techniques of incorporating color developing agents (for example, techniques as described in U.S. Pat. Nos. 3,719,492, 3,342,559, and 3,342,597, Unexamined Published Japanese Patent Application Nos. 6235/81, 16133/81, 97531/82, and 83565/82) are used, the use of such a technique is accompanied by a disadvantage that the color development is delayed and fog forms, and the techniques are improper.

Still further, as a process of completely removing benzyl alcohol from a color developer or a process of reducing the content of benzyl alcohol in a color developer, it is proposed to use a silver chlorobromide core/shell type emulsion containing 50 to 97 mol% of silver bromide, the content of silver bromide in the surface portion (shell portion) thereof being higher than that in the inside (core portion) thereof in Unexamined Published Japanese Patent Application No. 48755/84 or to employ relatively small silver halide grains of up to 0.6 μm and further to incorporate phenidone or a derivative thereof in light-sensitive material in Unexamined Published Japanese Patent Application No. 26339/85, which also teaches the use of a monodispersed emulsion having a variation coefficient of up to 0.15. However, these propositions are yet insufficient in the points of the color density obtained, etc., for processing light-sensitive materials in a short developing time of up to 2 minutes and 30 seconds using substantially no benzyl alcohol for the color developer.

The first object of this invention is, therefore, to provide a color image-forming process giving high color density in a short period of time using a color developer substantially free from benzyl alcohol.

The second object of this invention is to provide a color image-forming process giving less fog and with quick development

DISCLOSURE OF THE INVENTION

As the result of various investigations on attaining the aforesaid objects, the inventors have discovered that in the case of using a color photographic paper employing a core/shell surface latent image type monodispersed silver halide emulsion containing substantially no silver iodide, having a silver chloride content of up to 80 mol%, and having a silver bromide content in the shell portion lower than that in the core portion, high color density is obtained in a short developing time and the formation of fog is less even in the case of using a color developer containing substantially no benzyl alcohol, and they have achieved this invention.

That is, according to this invention, there is provided a color image-forming process which comprises developing a photographic light-sensitive material comprising a reflective support having provided thereon at least one silver halide emulsion layer containing a core/shell surface latent image type monodispersed silver halide emulsion containing substantially no silver iodide, having a silver chloride content of up to 80 mol%, and having a silver bromide content in the shell portion lower than that in the core portion with a color developer containing substantially no benzyl alcohol within 2 minutes and 30 seconds.

Now, the term "containing substantially no benzyl alcohol or substantially free from benzyl alcohol" used in this invention means the concentration of benzyl alcohol in a color developer is less than 0.5 ml/liter, preferably no benzyl alcohol is present in the color developer at all.

The core/shell surface latent image type monodispersed silver halide emulsion for use in this invention has an average grain size of, preferably, from 0.1 μm to 2 μm, and more preferably, from 0.2 μm to 1.3 μm in the expression by the diameter of an equivalent circle by projection. Also, the grain size distribution showing the extent of the monodispersion is, preferably, up to 0.15, and more preferably up to 0.10 in the ratio ($S/\bar{d}$) of the statistical standard deviation (S) to the average grain size ($\bar{d}$).

The surface latent image type monodispersed core/-shell silver halide emulsion for use in this invention can be produced by conventionally known processes. Typically, the surface latent image type monodispersed core/shell silver halide emulsion is obtained by simultaneously adding an aqueous solution of an alkali halide and an aqueous solution of silver nitrate at definite rates with vigorously stirring at a definite temperature to form a silver bromide emulsion or a silver chlorobromide emulsion as core, and further simultaneously adding an aqueous alkali halide solution and an aqueous silver nitrate solution to the silver halide emulsion thus formed in such an amounts that a content of silver chloride becomes higher than that of the aforesaid silver halide to form a layer (shell) of silver chloride or silver chlorobromide on the surfaces of the aforesaid core grains. In addition, about the core/shell emulsion, the description of Unexamined Published Japanese Patent Application No. 215540/86 can be referred.

For attaining the objects of this invention, it is preferred to control the amount of the aqueous alkali solution added such that the content of silver bromide in the core portion becomes at least 10 mol% (more preferably at least 15 mol%, and more preferably at least 20 mol%) higher than the silver bromide content in the shell portion.

A surface latent image type emulsion is an emulsion forming latent images mainly at the surface of the silver halide grains thereof upon exposure as well known in the field of the art and is distinguished from an internal latent image type emulsion forming latent images mainly in the inside of the grains.

The core/shell surface latent image type monodispersed silver halide emulsion which is used for the light-sensitive material in this invention contains silver bromide and/or silver chlorobromide substantially free from silver iodide and is preferably a silver chlorobromide emulsion containing from 2 mol% to 80 mol%, more preferably at least 2 mol% and less than 50 mol% of silver chloride.

The silver halide grains for use in this invention may have different phase between the inside and the surface layer thereof, may be a multiphase structure having a junction structure, or may be composed of a uniform phase through the whole grain. Also, the silver halide grains may be composed of a mixture of these silver halide grains.

The silver halide grains for use in this invention may have a regular crystal form such as cube, octahedron, dodecahedron, tetradecahedron, etc., an irregular crystal form such as sphere, etc., or a composite form of these crystal forms but has preferably a regular crystal form such as cube, tetradecahedron, etc. Also, a tabular grain may be used in this invention and in particular, an emulsion wherein tabular grains having a length/thickness ratio of at least 5, and particularly at least 8, account for at least 50% of the total projected area of grains can be preferably used in this invention. The emulsion may contain these various crystal forms as a mixture. These various kinds of silver halide emulsions are of a core/shell surface latent image type forming latent images mainly on the surface of grain thereof.

The photographic emulsions for use in this invention can be prepared by the methods described in P. Glafkides, *Chimie et Physique Photographique*, (published by Paul Montel, 1967). G.F. Duffin, *Photographic Emulsion Chemistry*, (published by Focal Press, 1966), V.L. Zelikman et al, *Making and Coating Photographic Emulsion*, (published by Focal Press, 1964), etc.

That is, the emulsion can be prepared by any of an acid method, a neutral method, an ammonia method, etc., and as one system of reacting a soluble silver salt and a soluble halide, any of a single jet method, a double jet method, and a combination thereof may be employed. A method of forming grains in the existence of excess silver ions (so-called reverse mixing method) can be also used. As one system of the double jet method, a method of keeping pAg in a liquid phase of forming silver halide constant, that is, a so-called controlled double jet method, can also be used. According to this method, an emulsion containing silver halide grains having a regular crystal form and substantially uniform grain size can be obtained.

Furthermore, an emulsion prepared by a so-called conversion method including a step of coverting a silver halide already formed before finishing the formation of the silver halide grains into a silver halide having small solubility product or a silver halide emulsion to which the similar halogenation conversion was applied after finishing the formation of the silver halide grains can also be used in this invention.

During the formation or physical ripening of the silver halide grains, a cadmium salt, a zinc salt, a thallium salt, an iridium salt or the complex salt thereof, a rhodium salt or the complex salt thereof, an iron salt or the complex salt thereof may exist in the system for the purposes of preventing the reciprocity failure, increasing sensitivity, or controlling gradation.

Silver halide emulsions are, after the formation of the silver halide grains, usually physically ripened, desalted, and chemically ripened before coating.

A known silver halide solvent (e.g., ammonia, potassium rhodanate, and thioether and thione compounds described in U.S. Pat. No. 3,271,157, Unexamined Published Japanese Patent Application Nos. 12360/76, 82408/78, 144319/78, 100717/79, 155828/79, etc.) can be used for the precipitation, physical ripening, and chemical ripening.

For removing soluble salts from emulsions after physical ripening, a noodle washing method, a flocculation method, or an ultrafiltration method can be employed.

The silver halide emulsions of the color light-sensitive materials for use in this invention can be sensitized by a sulfur sensitization method using active gelatin or a sulfur-containing compound capable of reacting with silver (e.g., thiosulfates, thiourea, mercapto compounds and rhodanines); a reduction sensitization method using a reducing substance (e.g., stannous salts, amines, hydrazine derivatives, formamidinesulfinic acid, silane compounds, etc.); a noble metal sensitization method using a metal compound (e.g., gold complex salts and complex salts of metals belonging to group VIII of the Periodic Table, such as Pt, Ir, Pd, Rh, Fe, etc.), or a combination thereof.

Of the above-described chemical sensitizations, the use of the sulfur sensitization singly is more preferred.

For meeting the desired gradation aimed by the color photographic light-sensitive material in this invention, a single layer or plural layers of silver halide emulsion layers having substantially same color sensitivity can be composed of two or more kinds of monodispersed silver halide emulsions (preferably having the above-described coefficient of deviation) each having different grain size as a mixture of the emulsions or with separately coating the emulsions in a form of multilayer, respectively. Furthermore, a combination of two or more kinds of monodispersed silver halide emulsions or a combination of a monodispersed emulsion and a polydispersed emulsion can be used in a single layer or plural layers.

The blue-sensitive emulsion, green-sensitive emulsion, and red-sensitive emulsion of the light-sensitive material which is used in this invention are spectrally sensitized by methine dyes, etc., such that these emulsions have each color sensitivity.

The dyes for use include cyanine dyes, merocyanine dyes, complex cyanine dyes, complex merocyanine dyes, holopolar cyanine dyes, hemicyanine dyes, styryl dyes, and hemioxonol dyes. Particularly useful dyes are dyes belonging to cyanine dyes, merocyanine dyes, and complex merocyanine dyes.

For these dyes can be applied nuclei ordinarily utilized for cyanine dyes as basic heterocyclic nuclei. That is, pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing an alicyclic hydrocarbon ring to the aforesaid nuclei, and the nuclei formed by fusing an aromatic hydrocarbon ring to the aforesaid nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc., can be applied. These nuclei may be substituted on carbon atoms.

For merocyanine dyes or complex merocyanine dyes may be applied 5-membered or 6-membered heterocyclic nuclei such as pyrazolin-5-one nuclei, thiohydantoin nuclei, 2-thiooxaz-oline-2,4-dione nuclei, thiazolidine-2,4-dione nuclei, rhodanine nuclei, thiobarbituric acid nuclei, etc., as a nucleus having a ketomethylene structure.

These sensitizing dyes may be used singly or as a combination thereof. A combination of sensitizing dyes is frequently used for the purpose of supersensitization. Typical examples of the combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,70, British Patents 1,344,281 and 1,507,803, Japanese Patent Publication Nos. 4936/68 and 12375/78, Unexamined Published Japanese Patent Application Nos. 110618/77, 109925/77, etc.

The emulsion for use in this invention may contain, together with the sensitizing dye (s), a dye having no spectral sensitizing activity by itself or a substance which does not substantially absorb visible light and shows supersensitizing activity.

It is preferred that the color couplers incorporated in the light-sensitive materials in this invention are rendered non-diffusible by a ballast group or by being polymerized. Furthermore, the use of 2-equivalent color couplers the coupling active position of which is substituted by a releasing group is more effective for reducing the amount of silver coated than the case of using 4-equivalent color couplers having a hydrogen atom at the coupling active position thereof. Couplers providing colored dyes having a proper diffusibility, colorless compound forming couplers, DIR couplers releasing a development inhibitor with the coupling reaction thereof or couplers releasing a development accelerator with the coupling reaction thereof can be used.

Typical examples of the yellow couplers for use in this invention are oil-protect type acylacetamide-series couplers. Specific examples of the couplers are described in U.S. Pat. Nos. 2,407,210, 2,875,057, 3,265,506, etc.

In this invention, 2-equivalent yellow couplers are preferably used and typical examples thereof are oxygen atom-releasing type yellow couplers described in U.S. Pat. Nos. 3,408,194, 3,447,928, 3,933,501, 4,022,620, etc., and nitrogen atom-releasing type yellow couplers described in Japanese Patent Publication No. 10739/83, U.S. Pat. Nos. 4,401,752 and 4,326,024, *Research Disclosure* (RD), No. 18053 (April, 1979), British Patent 1,425,020, West German Patent Application (OLS) Nos. 2,219,917, 2,261,361, 2,329,587, 2,433,812, etc. α-Pivaloylacetanilide-series couplers are excellent in fastness, in particular, light fastness of the colored dyes formed, while α-benzoylacetanilide-series couplers give high color density.

As the magenta couplers for use in this invention, there are oil-protect type indazolone-series or cyanoacetyl-series magenta couplers, preferably 5-pyrazolone-series couplers and pyrazoloazole-series couplers such as pyrazolo-triazole-series couplers.

As the 5-pyrazolone-series couplers, the couplers having an arylamino group or an acylamino group at the 3-position are preferred in the view points of the hue of the colored dyes and color density. Typical examples of the couplers are described in U.S. Pat. Nos. 2,311,082, 2,343,703, 2,600,788, 2,908,573, 3,062,653, 3,152,896, 3,936,015, etc. Preferred releasing groups for the 2-equivalent 5-pyrazolone-series couplers include nitrogen atom-releasing groups described in U.S. Patent 4,310,619 and arylthio groups described in U.S. Pat. No. 4,351,897. Also, 5-pyrazolone-series couplers having a ballast group described in European Patent 73,636 give high color density.

Pyrazoloazole-series couplers include pyrazolobenzimidazoles described in U.S. Patent 3,369,879, preferably pyrazolo[5,1-c][1,2,4]triazoles described in U.S. Pat. No. 3,725,067, pyrazolotetrazoles described in *Research Disclosure*, No. 24220 (June, 1984), and pyrazolotetrazoles described in *Research Disclosure*, No. 24230 (June, 1984). From the view point of less yellow side absorption of colored dyes and high light fastness of colored dyes, imidazo-[1,2-b]pyrazoles described in European Patent 119,741 are preferred and pyrazolo[1,5-b][1,2,4]triazoles described in European Patent 119,860 are particularly preferred.

Cyan couplers for use in this invention include oil-protect type naphthoic and phenolic couplers.

Typical examples of the naphtholic couplers include naphthoic couplers described in U.S. Pat. No. 2,474,293, and preferably oxygen atom-releasing type 2-equivalent naphthoic couplers described in U.S. Pat. Nos. 4,052,212, 4,146,396, 4,228,233 and 4,296,200. Also, specific examples of the phenolic couplers are described in U.S. Pat. Nos. 2,369,929, 2,801,171, 2,772,162, 2,895,826, etc. The cyan couplers having high fastness to moisture and heat are preferably used in this invention, and typical examples thereof are the phenolic cyan couplers having an ethyl group or higher alkyl group at the meta-position of the phenol nucleus described in U.S. Pat. Nos. 3,772,002, 2,5-diacylamino-substituted phenolic couplers described in U.S. Pat. Nos. 2,772,162, 3,758,308, 4,126,396, 4,334,011 and 4,327,173, West German Patent Application (OLS) No. 3,329,729, Japanese Patent Application No. 42671/83, etc., and phenolic couplers having a phenylureido group at the 2-position thereof and an acylamino group at the 5-position thereof described in U.S. Pat. Nos. 3,446,622, 4,333,999, 4,451,559, 4,427,767, etc.

The graininess can be improved by using a coupler giving colored dye having a proper diffusibility together. In regard to such couplers giving diffusible dyes, specific examples of the magenta couplers are described in U.S. Pat. No. 4,366,237 and British Patent 2,125,570 and specific examples of the yellow, magenta, and cyan couplers are described in European Patent 96,570 and West German Patent Application (OLS) No. 3,234,533.

The dye-forming couplers and the specific couplers described above may form a dimer or higher polymer. Typical examples of the polymerized dye-forming couplers are described in U.S. Pat. Nos. 3,451,820 and 4,080,211. Also, specific examples of the polymerized magenta couplers are described in British Patent 2,102,173 and U.S. Pat. No. 4,367,282.

The couplers for use in this invention can be used for one light-sensitive emulsion layer as a mixture of two or more for meeting the properties required for the light-sensitive material or the same kind of compound may exist in different, two or more layers.

The couplers for use in this invention can be introduced into light-sensitive materials by an oil drop-in-water dispersion method. That is, the coupler is dissolved in a single solution of a high boiling organic solvent having boiling point of at least 175° C. or a low boiling so-called auxiliary solvent, or a mixture solution of both types of solvents, and then finely dispersed in water or an aqueous medium such as an aqueous gelatin solution in the presence of a surface active agent. Examples of the high boiling organic solvent are described in U.S. Pat. No. 2,322,027, etc. In this case, the coupler may be dispersed with phase inversion and also, if necessary, the auxiliary solvent may be removed or reduced by distillation, noodle washing, ultrafiltration, etc. before coating the dispersion.

Specific examples of the high boiling organic solvent are phthalic acid esters (e.g., dibutyl phthalate, dicyclohexyl phthalate, di-2-ethylhexyl phthalate, decyl phthalate, etc.), phosphoric acid esters or phosphonic acid esters (e.g., triphenyl phosphate, tricresyl phosphate, 2ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexyl phenyl phosphate, etc.), benzoic acid esters (e.g., 2-ethylhexyl benzoate, dodecyl benzoate, 2-ethylhexyl-p-hydroxy benzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

As the auxiliary solvent, organic solvents having boiling point of at least about 30° C., preferably from about 50° C. to about 160° C. can be used, and specific examples thereof are ethyl acetate, butyl acetate, ethyl propionate, methyl ethyl ketone, cyclohexanone, 2-ethoxyethyl acetate, dimethylformamide, etc.

The process and effect of the latex dispersing method and specific examples of the latex for impregnation are described in U.S. Pat. No. 4,199,363, West German Patent Application (OLS) Nos. 2,541,274, 2,541,230, etc.

A standard amount of the color coupler is in the range of from 0.001 mol to 1 mol per mol of the light-sensitive silver halide, with from 0.01 mol to 0.5 mol of a yellow coupler, from 0.003 mol to 0.3 mol of a magenta coupler, and from 0.002 mol to 0.3 mol of a cyan coupler, per mol of the light-sensitive silver halide being preferred.

The light-sensitive materials for use in this invention may further contain hydroquinone derivatives, aminophenol derivatives, amines, gallic acid derivatives, catechol derivatives, ascorbic acid derivatives, colorless compound-forming couplers, sulfonamidophenol derivatives, etc., as color fog preventing agents or color stain preventing agents.

Also, the light-sensitive materials for use in this invention can further contain known discoloration inhibitors. Typical examples of organic color stain preventing agents are hydroquinone, 6-hydroxychromans, 5-hydroxycoumarans, spirochromans, p-alkoxyphenols, bisphenols, hindered phenols, gallic acid derivatives, methylenedioxybenzenes, aminophenols, hindered amines, and the ether or ester derivatives of the aforesaid compounds obtained by silylating or alkylating the phenolic hydroxy groups of these compounds. Also, metal complexes represented by (bissalicylaldoxymato)-nickel complexes and (bis-N,N-dialkyldithiocarbamato)nickel complexes can also be used.

For preventing the deterioration of yellow dye images by heat, moisture, and light, the compound having both moiety structures of hindered amine and hindered phenol in one molecule as described in U.S. Pat. No. 4,268,593 gives good results. Also, for preventing the deterioration of magenta dye images, particularly by light, spiroindans described in Unexamined Published Japanese Patent Application No. 159644/81 and chromans substituted by hydroquinone diether or monoether described in Unexamined Published Japanese Patent Application No. 89835/80 give preferred results.

For improving the storage stability, in particular, the light fastness of cyan dye images, it is preferred to use a benzotriazole-series ultraviolet ray absorbent together. This ultraviolet ray absorbent may be co-emulsified with the cyan coupler(s). The coating amount of the ultraviolet ray absorbent is desirably sufficient for imparting light stability to cyan dye images, but if the amount is too much, the unexposed portions (background portions) of the color photographic light-sensitive material are sometimes yellowed, the amount thereof is usually selected in the range of from $1 \times 10^{-4}$ mol/m$^2$ to $2 \times 10^{-3}$ mol/m$^2$, and particularly from $5 \times 10^{-4}$ mol/m$^2$ to $1.5 \times 10^{-3}$ mol/m$^2$.

In the light-sensitive layer structure of an ordinary color photographic paper, the ultraviolet ray absorbent(s) are incorporated in one or both layers adjacent to a red-sensitive emulsion layer containing cyan coupler. When the ultraviolet ray absorbent(s) are incorporated in the interlayer between a green-sensitive layer and a red-sensitive layer, the ultraviolet ray absorbent(s) may be emulsified together with a color stain preventing agent. When the ultraviolet ray absorbent(s) are incorporated in a protective layer, another protective layer may be formed as the outermost layer. The protective layer may contain a matting agent having a proper particle size, etc.

In the light-sensitive materials for use in this invention, the ultraviolet ray absorbent(s) can be incorporated in hydrophilic colloid layers.

The light-sensitive materials for use in this invention may further contain water-soluble dyes in the hydrophilic colloid layers as filter dyes or for the purpose of irradiation prevention, halation prevention, and the like.

The light-sensitive materials for use in this invention may further contain whitening agents such as stilbene-series, triazine-series, oxazole-series, or coumarin-series whitening agents in the photographic emulsion layers or other hydrophilic colloid layers. The whitening agent may be water-soluble, or a water-insoluble whitening agent may be used in the form of a dispersion.

The process of this invention can be applied to a multilayer multicolor photographic material having at least two emulsion layers each having different spectral sensitivity on a support. A multilayer natural color photographic material usually has at least one red-sensitive emulsion layer, at least one green-sensitive emulsion layer, and at least one blue-sensitive emulsion layer on a support. The order of these layers may be optionally selected as the case demands. Also, each of the aforesaid emulsion layers may be composed of two or more emulsion layers each having different sensitivity or a light-insensitive layer may exist between two or more emulsion layers each having the same sensitivity.

The light-sensitive material for use in this invention preferably has auxiliary layers such as protective layer(s), interlayers, a filter layer, an antihalation layer, a back layer, etc., in addition to the silver halide emulsion layers.

As a binder or protective colloid which can be used for the emulsion layers and auxiliary layers of the light-sensitive material for use in this invention, gelatin is advantageously used but other hydrophilic colloids can also be used.

For example, proteins such as gelatin derivatives, graft polymers of gelatin and other polymers, albumin, casein, etc.; cellulose derivatives such as hydroxyethyl cellulose, carboxymethyl cellulose, cellulose sulfuric acid ester, etc.; saccharose derivatives such as sodium alginate, starch derivatives, etc.; and various synthetic hydrophilic polymeric substance such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., can be used.

As gelatin, lime-processed gelatin as well as acid-processed gelatin and enzyme-processed gelatin as described in *Bull. Soc. Sci. Photo. Japan*, No. 16, p. 30 (1966) can be used. Furthermore, the hydrolyzed product or enzyme-decomposed product of gelatin can be used.

The light-sensitive materials for use in this invention may further contain various stabilizers, stain preventing agents, developing agents or the precursors thereof, development accelerators or the precursors thereof, lubricants, mordants, matting agents, antistatic agents, plasticizers, or other various additives useful for photographic light-sensitive materials in addition to the above-described additives. Typical examples of such additives are described in *Research Disclosure*, No. 17643 (December, 1978) and *ibid.*, No. 18716 (November, 1979).

The "reflective support" for use in this invention is a support having high reflectivity for clearly viewing color images forming in silver halide emulsion layer(s) and includes a support coated with a hydrophilic resin having dispersed therein a light reflective substance such as titanium oxide, zinc oxide, calcium carbonate, calcium sulfate, etc., and a support composed of a hydrophobic resin containing the light reflective substance in a dispersed state. Examples of such support include baryta papers, polyethylene-coated papers, polypropylene-series synthetic papers, and transparent supports coated with the reflective layer or containing the reflective substance, such as glass plates, polyester films, e.g., polyethylene terephthalate, cellulose triacetate, cellulose nitrate, etc., polyamide films, polycarbonate films, polystyrene films, etc. These supports can be properly selected according to the using purpose thereof.

Then, the processing steps (image-forming steps) of this invention are described.

In the color image processing step in this invention, the processing time is as short as up to 2 min. and 30 sec., preferably from 30 sec. to 2 min. and 30 sec. The processing time in this case is a period from the time at which a light-sensitive material is brought into contact with a color developer to the time of the light-sensitive material coming into contact with the subsequent bath and includes the transporting time between both baths.

A color developer which is used for the development process of this invention is preferably an alkaline aqueous solution containing an aromatic primary amine-series color developing agent as the main component. As the color developing agent, p-phenylenediamine-series compounds are preferably used and typical examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and the sulfates, hydrochlorides, phosphates, p-toluenesulfonates, tetraphenylborates, p-(t-octyl)benzenesulfonates, etc., thereof. In particular, the use of 3-methyl-4-amino-N-ethyl-N-β-methanesulfonamide and the salts thereof is preferred.

Aminophenol-series derivatives include, for example, o-aminophenol, p-aminophenol, 4-amino-2-methylphenol, 2-amino-3-methylphenol, 2-oxy-3-amino-1,4-dimethylbenzene, etc.

Other color developing agents described in L.F.A. Mason, *Photographic Processing Chemistry*, pages 226-229, published by Focal Press, (1966), U.S. Pat. Nos. 2,193,015 and 2,592,364, Unexamined Published Japanese Patent Application No. 64933/73, etc., may also be used. If necessary, a combination of two or more kinds of color developing agents can be used.

The processing temperature of the color developer in this invention is preferably from 30° C. to 50° C., and more preferably from 35° C. to 45° C.

As the development accelerator, various compounds may be used provided that benzyl alcohol is not substantially contained therein. Examples of the development accelerator are various pyrimidium compounds described in U.S. Pat. No. 2,648,604, Japanese Patent Publication No. 9503/69 and British Patent 3,171,247, other cationic compounds, cationic dyes such as phenosafranine, etc., neutral salts such as thallium nitrate, potassium nitrate, etc., polyethylene glycol and the derivatives thereof described in Japanese Patent Publication No. 9304/69, U.S. Pat. Nos. 2,533,990, 2,531,832, 2,950,970 and 2,577,127, nonionic compounds such as polythioethers, etc., thioether-series compounds described in U.S. Pat. No. 3,201,242, etc., and other compounds described in Unexamined Published Japanese Patent Application Nos. 156934/83 and 220344/85.

In short-time development processing as in this invention, not only the technique of accelerating the development but also the technique of preventing the formation of developing fog are important. As antifoggants for use in this invention, alkali metal halides such as potassium bromide, sodium bromide or potassium iodide, and organic antifoggants are preferred. As the organic antifoggants, there are nitrogen-containing heterocyclic compounds such as benzotriazole, 6-nitrobenzimidazole, 5-nitroisoindazole, 5methylbenzotriazole, 5-nitrobenzotriazole, 5-chloro-benzotriazole, 2-thiazolyl-benzimidazole, 2-thiazolemethylbenzimidazole or hydroxyazaindolizine, mercaptosubstituted heterocyclic compounds such as 1-phenyl-5-mercaptotetrazole, 2-mercaptobenzimidazole or 2-mercaptobenzothiazole, and mercapto-substituted aromatic compounds such as thiosalicylic acid. Particularly preferred antifoggants are the halides. The antifoggants may be accumulated in a color developer dissolved out from color light-sensitive materials during processing.

In addition, the color developers for use in this invention may further contain pH buffers such as carbonates, borates or phosphates of an alkali metal; preservatives such as hydroxylamine, triethanolamine, the compounds described in West German Patent Application (OLS) No. 2,622,950, sulfites or bisulfites; organic solvents such as diethylene glycol, etc.; dye-forming couplers; competing couplers; nucleating agents such as sodium borohydride; auxiliary developing agents such as 1-phenyl-3-pyrazolidone; viscosity imparting agents; and chelating agents such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, aminopolycarboxylic acid represented by the compounds described in Unexamined Published Japanese Patent Application No. 195845/83, etc., 1-hydroxyethylidene-1,1'-diphosphonic acid, the organic phosphonic acids described in *Research Disclosure*, No. 18170 (May, 1979), aminophosphonic acids, e.g., aminotris(methylenephosphonic acid), ethylenediamine-N,N,N'-tetramethylenephosphonic acid, etc., phosphonocarboxylic acids described in Unexamined Published Japanese Patent Application Nos. 102726/77, 42730/78, 121127/79, 4024/80, 4025/80, 126241/80, 65955/80, 65956/80, and *Research Disclosure*, No. 18170 (May, 1979), etc.

Also, the color developing bath is composed of two or more baths and a replenisher for the color developer may be supplied from the foremost bath or the last bath to reduce the development time and the amount of the replenisher.

The silver halide color light-sensitive materials are usually subjected to bleach processing after color development. The bleach process may be performed simultaneously (bleach-fix or blix) with or separately from a fix process.

As the bleaching agent, compounds of polyvalent metals such as iron(III), cobalt(III), chromium(VI), copper(II), etc., peracids, quinones, nitroso compounds, etc., are used. Specific examples of the bleaching agent include ferricyanides; dichromates; organic complex salts of iron(III) or cobalt(III); organic complex salts of aminopolycarboxylic acids, e.g., ethylenediaminetetraacetic acid, diethylenetriaminepentaacetic acid, nitrilotriacetic acid, 1,3-diamino-2-propanoltetraacetic acid, etc., or other organic acids, e.g., citric acid, tartaric acid, malic acid, etc.; persulfates; manganates; nitrosophenol; etc., can be used. Of these substances, potassium pherricyanide, sodium ethylenediaminetetraacetato ferrate, ammonium ethylenediaminetetraacetato ferrate, ammonium triethylenetetraminepentaacetato ferrate, and persulfates are particularly advantageous. Ethylenediaminetetraacetic acid iron(III) complex salts are advantageously used for a bleach solution or a mono bath blix solution.

Also, the bleach solution or the blix solution may contain, if necessary, various kinds of accelerators. Examples of such accelerators are bromine ions, iodine ions as well as thiourea-series compounds described in U.S. Pat. No. 3,706,561, Japanese Patent Publication Nos. 8506/70 and 26586/74, Unexamined Published Japanese Patent Application Nos. 32735/78, 36233/78, and 37016/78, thiol-series compounds described in Unexamined Published Japanese Patent Application Nos.

124424/78, 95631/78, 57831/78, 32736/78, 65732/78, and 52534/79, U.S. Pat. No. 3,893,858, etc., heterocyclic compounds described in Unexamined Published Japanese Patent Application Nos. 59644/74, 140129/75, 28426/78, 141623/78, 104232/78, 35727/79, etc., thioether-series compounds described in Unexamined Published Japanese Patent Application Nos. 20832/77, 25064/80, 26506/80, etc., quaternary amines described in Unexamined Published Japanese Patent Application No. 84440/73, and thiocarbamoyls described in Unexamined Published Japanese Patent Application No. 42349/74.

As a fixing agent, there are thiosulfates, thiocyanates, thioether-series compounds, thioureas, a large amount of iodide, etc., but thiosulfates are generally used. As preservatives for the blix solution or fix solution, sulfites, bisulfites, or carbonyl-bisulfite adducts are preferably used.

After the blix or fix, water washing is usually performed. In the wash step various kinds of compounds may be added for the purposes of preventing precipitation or saving water. For example, there are water softeners such as inorganic phosphoric acids, aminopolycarboxylic acids, organic phosphoric acids, etc., for preventing precipitation, antibacterial or antifungal agents for preventing the growth of various bacteria, algae, fungi, etc., hardening agents represented by magnesium salts, aluminum salts, etc., and surface active agents for reducing drying load or preventing drying unevenness. Furthermore, the compounds described in L.E. West, *Photographic Science and Engineering*, Vol. 9, No. 6, (1965) may be added. The addition of chelating agents or antifungal agents is particularly effective. Also, by employing a multistage (e.g., 2 to 5 stages) countercurrent system for the wash step, the amount of water can also be saved.

Furthermore, after or in place of the wash step, a multistage countercurrent stabilization step as described in Unexamined Published Japanese Patent Application No. 8543/82 may be practiced. In the case of employing the stabilization step, 2 to 9 countercurrent baths are necessary. To the stabilization bath are added various compounds for stabilizing color images. Examples of such compounds are buffers for adjusting the pH of layers (e.g., borates, metaborates, borax, phosphates, carbonates, potassium hydroxide, sodium hydroxide, aqueous ammonia, monocarboxylic acid, dicarboxylic acid, polycarboxylic acid, etc.) and formalin. Furthermore, water softeners (e.g., inorganic phosphoric acids, aminopolycarboxylic acids, organic phosphoric acids, aminopolyphosphonic acids, phosphonocarboxylic acids, etc.), biocides (e.g., Proxel, isothiazolone, 4-thiazolylbenzimidazole, halogenated phenolbenzotriazoles, etc.), surface active agents, brightening agents, hardening agents, etc., may be added to the stabilization bath.

Also, as a pH controlling agent for layers after processing, various ammonium salts such as ammonium chloride, ammonium nitrate, ammonium sulfate, ammonium phosphate, ammonium sulfite, ammonium thiosulfate, etc., can be added to the stabilization bath.

BEST MODE FOR PRACTICING THE INVENTION

Then, the invention is explained in more detail based on the following examples.

Example 1

A multilayer color photographic paper having the layer structure shown in Table I below on a paper support both surfaces of which were laminated with polyethylene was prepared. The coating solutions were prepared as follows.

Preparation of Coating Solution For Layer 1:

27.2 ml of ethyl acetate and 7.9 ml of solvent (c) were added to 19.1 g of yellow coupler (a) and 4.4 g of color image stabilizer (b), the mixture was dissolved and the solution formed was emulsified and dispersed in 185 ml of an aqueous 10% gelatin solution containing 8 ml of 10% sodium dodecylbenzenesulfonate. On the other hand, 90 g of an emulsion was prepared by adding the blue-sensitive sensitizing dye shown below to a silver chlorobromide emulsion (containing 80 mol% silver bromide and 70 g/kg of Ag) in an amount of $7.0\times 10^{-4}$ mol per mol of silver chlorobromide. The emulsified dispersion prepared above was mixed with the emulsion prepared above, the mixture was dissolved and the gelatin concentration was adjusted so as to realize the composition shown in Table I to provide the coating solution for layer 1.

Coating solutions for layer 2 to layer 7 were also prepared in accordance with the aforesaid manner of preparing the coating solution for layer 1.

In addition, 1-oxy-3,5-dichloro-s-triazine sodium salt was used as a gelatin hardening agent for each layer.

As spectral sensitizers for each emulsion, the following sensitizers were used.

For blue-sensitive emulsion layer:

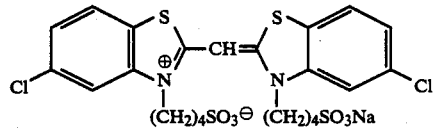

(added in an amount of $7.0\times 10^{-4}$ mol per mol of silver halide)

For green-sensitive emulsion layer:

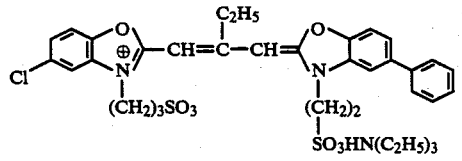

(added in an amount of $4.0\times 10^{-4}$ mol per mol of silver halide)

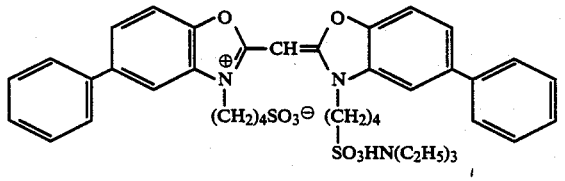

(added in an amount of $7.0\times 10^{-5}$ mol per mol of silver halide)

For red-sensitive emulsion layer:

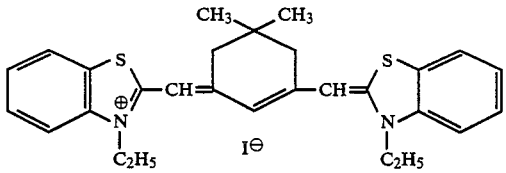

(added in an amount of $1.0 \times 10^{-4}$ mol per mol of silver halide)

As irradiation preventing dyes for each emulsion layer, the following dyes were used.

For green-sensitive emulsion layer:

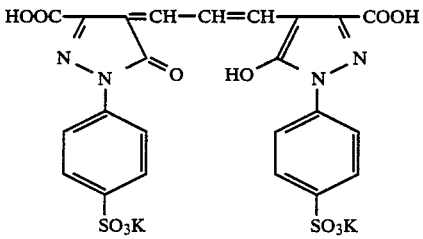

For red-sensitive emulsion layer:

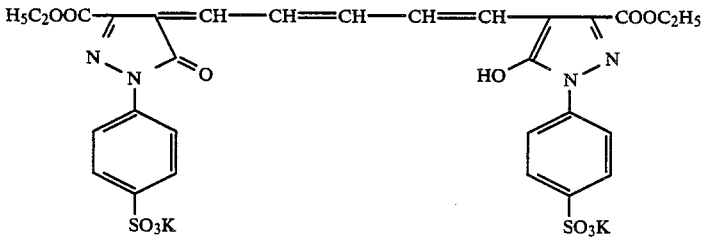

The structural formulae of the compounds such as couplers, etc., used in the example are shown below.

(a) Yellow coupler:

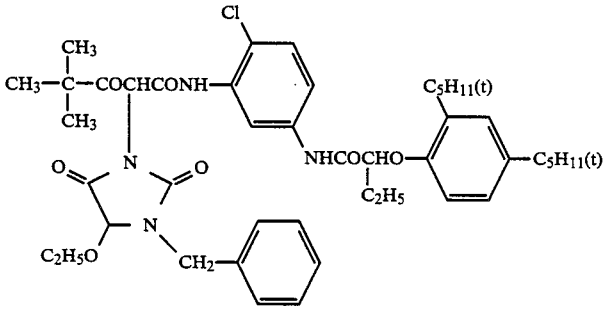

(b) Color image stabilizer:

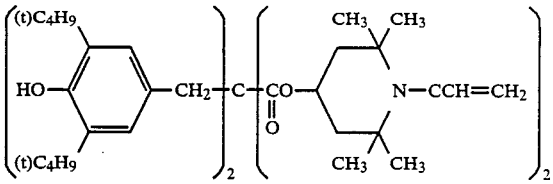

(c) Solvent:

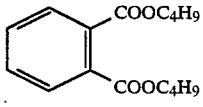

(d)

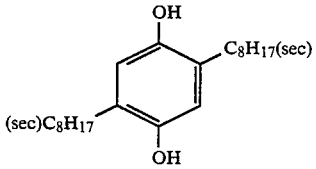

(e) Magenta coupler:

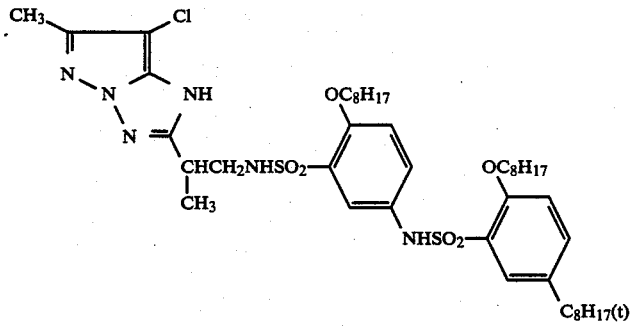
(f) Color image stabilizer:
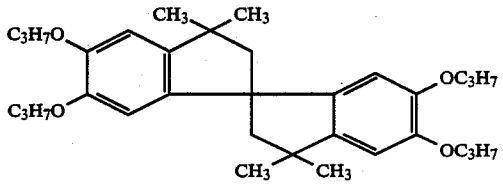
(g) Solvent:
Mixture of $(C_8H_{17}O)_3-P=O$ and (
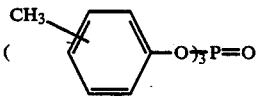
(2 : 1 by weight ratio)
(h) Ultraviolet ray absorbent:
Mixture of
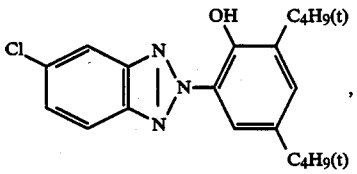
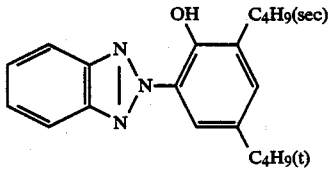
and
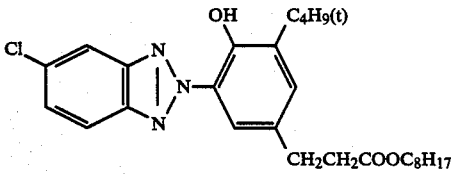
(1 : 5 : 3 by mol ratio)
(i) Color stain preventing agent:
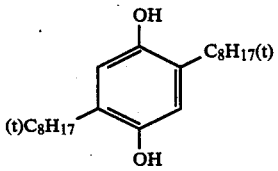
(i) Solvent
$(iso\text{-}C_9H_{18}O)_3P=O$
(k) Cyan coupler:
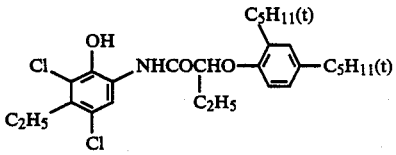
and
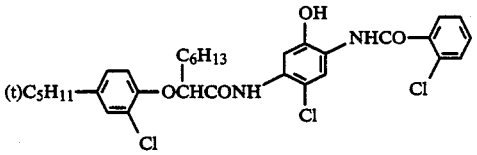
$(K_2)$
(1 : 1 by mol ratio)
(l) Color image stabilizer:
Mixture of
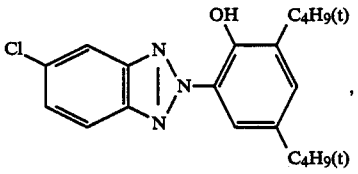
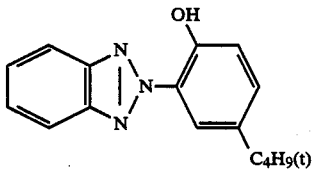
and -continued

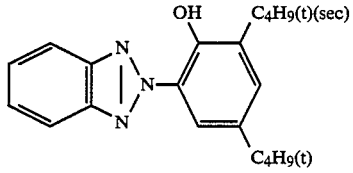

(1 : 3 : 3 by mol ratio)
(m) Solvent

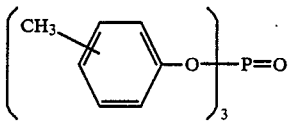

TABLE 1

| Layer | Main Formulation | Amount used |
|---|---|---|
| Layer 7 (Protective layer) | Gelatin | 1.33 g/m² |
| | Acryl-modified copolymer of polyvinyl alcohol (modification degree: 17%) | 0.17 g/m² |
| Layer 6 (UV ray absorbing layer) | Gelatin | 0.54 g/m² |
| | Ultraviolet ray absorbent (h) | 0.21 g/m² |
| | Solvent (i) | 0.09 cc/m² |
| Layer 5 (Red-sensitive layer) | Silver chlorobromide emulsion (AgBr: 70 mol %), Silver amount: | 0.26 g/m² |
| | Gelatin | 0.98 g/m² |
| | Cyan Coupler (k) | 0.38 g/m² |
| | Color image stabilizer (l) | 0.17 g/m² |
| | Solvent (m) | 0.23 cc/m² |
| Layer 4 (UV ray absorbing layer) | Gelatin | 1.60 g/m² |
| | Ultraviolet ray Absorbent (h) | 0.62 g/m² |
| | Color stain preventing agent (i) | 0.05 g/m² |
| | Solvent (j) | 0.26 cc/m² |
| Layer 3 (Green-sensitive layer) | Silver chlorobromide emulsion (AgBr: 75 mol %), silver amount: | 0.16 g/m² |
| | Gelatin | 1.80 g/m² |
| | Magenta coupler (e) | 0.34 g/m² |
| | Color image stabilizer (f) | 0.20 g/m² |
| | Solvent (g) | 0.68 cc/m² |
| Layer 2 (Color stain preventing layer) | Gelatin | 0.99 g/m² |
| | Color stain preventing agent (d) | 0.08 g/m² |
| Layer 1 (Blue-sensitive layer) | Silver chlorobromide emulsion (AgBr: 80 mol %), silver amount: | 0.34 g/m² |
| | Gelatin | 1.86 g/m² |
| | Yellow Coupler (a) | 0.82 g/m² |
| | Color image stabilizer (b) | 0.19 g/m² |
| | Solvent (c) | 0.34 cc/m² |
| Support | Polyethylene-laminated paper (polyethylene at the layer 1 side contained a white pigment ($TiO_2$) and a bluish dye (ultramarine) | |

Silver halide emulsion (1) for a comparison blue-sensitive emulsion layer was prepared as follows.

(Solution 1)

-continued

| | |
|---|---|
| $H_2O$ | 1000 cc |
| NaCl | 5.5 g |
| Gelatin | 25 g |
| (Solution 2) | |
| Sulfuric acid (IN) | 20 cc |
| (Solution 3) | |
| Silver halide emulsion (1%) of the following structure | 2 cc |

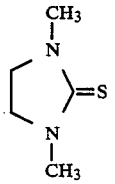

| | |
|---|---|
| (Solution 4) | |
| KBr | 2.80 g |
| NaCl | 0.34 g |
| Water to make | 140 cc |
| (Solution 5) | |
| $AgNO_3$ | 5 g |
| Water to make | 140 cc |
| (Solution 6) | |
| KBr | 67.20 g |
| NaCl | 8.26 g |
| $K_2IrCl_6$ (0.001%) | 0.7 cc |
| Water to make | 320 cc |
| (Solution 7) | |
| $AgNO_3$ | 120 g |
| Water to make | 320 cc |

(Solution 1) was heated to 75° C. and (Solution 2) and (Solution 3) were added thereto. Thereafter, (Solution 4) and (Solution 5) were simultaneously added to the mixture over a 9 minute period. After 10 minutes, (Solution 6) and (Solution 7) were simultaneously added thereto over a 45 minute period. After 5 minutes since the addition, the temperature of the mixture was lowered and desalting was performed. Then, water and dispersed gelatin were added to the mixture and the pH of the resultant mixture was adjusted to 6.2 to provide a monodispersed cubic silver chlorobromide emulsion having an average grain size of 1.01 μm, a variation coefficient (i.e., a value obtained by dividing a standard deviation by average grain size: $s/\bar{d}$) of 0.08, and containing 80 mol% of silver bromide. Then, sodium thiosulfate was added to the emulsion to apply thereto optimum chemical sensitization.

Silver halide emulsion (2) for comparison blue-sensitive emulsion layer and silver halide emulsion (3) for comparison green-sensitive and red-sensitive emulsion layers were prepared by the same manner as above while changing the amounts of chemicals, the temperature, and the times.

Silver halide emulsion (4) for comparison blue-sensitive emulsion layer was prepared as follows.

| | |
|---|---|
| (Solution 8) | |
| $H_2O$ | 700 cc |
| NaCl | 39.4 g |
| Gelatin | 28 g |
| (Solution 9) | |
| Sulfuric acid (1N) | 10 cc |
| (Solution 10) | |
| KBr | 78.4 g |
| $K_2IrCl_6$ (0.001%) | 0.7 cc |
| Water to make | 800 cc |
| (Solution 11) | |
| $AgNO_3$ | 140 g |
| Water to make | 800 cc |

(Solution 8) was heated to 75° C. and (Solution (b 9) was added thereto. Thereafter, (Solution 10) was added to the mixture over a 40 minute period and further after one minute since the initiation of the addition of (Solution 10), (Solution 11) was added thereto over a 40 minute period. After 5 minutes since the addition, the temperature of the mixture was lowered and desalting was performed. Then, water and dispersed gelatin were added to the mixture and the pH of the resultant mixture was adjusted to 6.2 to provide a polydispersed silver chlorobromide emulsion having an average grain size of 0.82 μm, a deviation coefficient of 0.27, and containing 80 mol% of silver bromide. Then, sodium thiosulfate was added to the emulsion to apply thereto optimum chemical sensitization.

Silver halide emulsion (5) for comparison green-sensitive and red-sensitive emulsion layers was also prepared by the same manner as above while changing the amounts of chemicals, the temperature, and the time.

Silver halide emulsion (6) for the blue-sensitive emulsion layer of this invention was prepared as follows.

| | |
|---|---|
| (Solution 12) | |
| $H_2O$ | 1000 cc |
| NaCl | 17.5 g |
| Gelatin | 25 g |
| (Solution 13) | |
| Sulfuric acid (1N) | 20 cc |
| (Solution 14) | |
| Silver halide emulsion of the following structure (1%) | 3 cc |

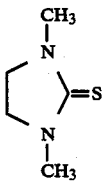

| | |
|---|---|
| (Solution 15) | |
| KBr | 17.5 g |
| Water to make | 130 cc |
| (Solution 16) | |
| $AgNO_3$ | 25 g |
| Water to make | 130 cc |
| (Solution 17) | |
| KBr | 52.50 g |
| NaCl | 8.60 g |
| $K_2IrCl_6$ (0.001%) | 0.7 cc |
| Water to make | 285 cc |
| (Solution 18) | |
| $AgNO_3$ | 100 g |
| Water to make | 285 cc |

(Solution 12) was heated to 75° C. and (Solution 13) and (Solution 14) were added thereto. Thereafter, (Solution 15) and (Solution 16) were simultaneously added to the mixture over a 20 minute period. Furthermore, after 10 minutes, (Solution 17) and (Solution 18) were simultaneously added to the mixture over a 25 minute period. After 5 minutes since the addition, the temperature of the mixture was lowered and desalting was performed. Then, water and dispersed gelatin were added thereto and the pH of the resultant mixture was adjusted to 6.2 to provide a monodispersed cubic silver chlorobromide emulsion having an average grain size of 1.00 μm, a variation coefficient (the value obtained by dividing a standard deviation by average grain size) of 0.07, and containing 80 mol% of silver bromide.

Then, sodium thiosulfate was added to the emulsion to apply thereto optimum chemical sensitization.

Silver halide emulsion (7) for the green-sensitive and red-sensitive emulsion layers of this invention was also prepared by the same manner as above while changing the amount of chemicals, the temperature, and the times.

The average grain sizes, variation coefficients, and halogen compositions of silver halide emulsions (1) to (7) thus obtained are shown in Table 2 below.

Samples (A), (B), (C), and (D) were prepared by replacing the emulsions shown in Table 1 with aforesaid silver halide emulsions (1) to (7). These structures are shown in Table 3.

TABLE 2

| Emulsion | Average Grain Size (μm) | Variation Coefficient (s/d) | Halogen Composition (%) |
|---|---|---|---|
| (1) Comparison example | 1.01 | 0.08 | Br = 80, Cl = 20 |
| (2) Comparison example | 0.80 | 0.07 | Br = 80, Cl = 20 |
| (3) Comparison example | 0.49 | 0.08 | Br = 80, Cl = 20 |
| (4) Comparison example | 0.82 | 0.27 | Br = 80, Cl = 20 |
| (5) Comparison example | 0.45 | 0.26 | Br = 80, Cl = 20 |
| (6) This invention | 1.00 | 0.07 | Br = 80, Cl = 20 |
| (7) This invention | 0.53 | 0.06 | Br = 80, Cl = 20 |

Emulsion (1) to (3) were not core/shell emulsions but AgBr was distributed uniformly in the grains. Emulsions (4) and (5) were not core/shell emulsions and AgBr was not uniformly distributed in the grains (that is, AgBr was non-uniformly distributed in the grains). Emulsions (4) and (5) were polydisperse emulsions having variation coefficients of 0.27 and 0.26, respectively, which were different from those of the present invention. Emulsions (6) and (7) were core/shell emulsions where the AgBr content of the core was 100 mol% (that is, the core was AgBr itself) and the AgBr content of the shell was 75 mol% (that is, the remainder was 25 mol% AgCl).

TABLE 3

| Sample | Emulsion | | |
|---|---|---|---|
| | Blue-Sensitive Layer | Green-Sensitive Layer | Red-Sensitive Layer |
| (A) | (1) Comparison example | (3) Comparison example | (3) Comparison example |
| (B) | (1) + (2) (4/6*) Comparison example | (3) Comparison example | (3) Comparison example |
| (C) | (4) Comparison example | (5) Comparison example | (5) Comparison example |
| (D) | (6) This invention | (7) This invention | (7) This invention |

*4/6 is a weight ratio of (1)/(2)

Each of Samples (A), (B), (C), and (D) described above was subjected to sensitometric gradation exposure through each of blue, green, and red filters using a sensitometer (Type FWH, color temperature of light source: 3,200° K, made by Fuji Photo Film Co., Ltd.). In this case, the exposure was performed in such a manner that the exposure amount became 250 CMS for an exposure time of 0.5 second.

Thereafter, each sample was subjected to processing A or processing B using color developer (A) or color developer (B), respectively, as shown below.

Each processing was composed of a color development step, a blix step, and a wash step and by changing the developing time to 1 minute, 2 minutes, and 3 minutes, the photographic properties were evaluated. Processing A was different from processing B only in the composition of color developer A and color developer B and the processing A was the same as the processing B in other contents. The results obtained are shown in Table 4 below.

The evaluation of the photographic properties was performed on a four-point evaluation such as the relative sensitivity, the gradation, the maximum density (Dmax), and the minimum density (Dmin).

The relative sensitivity is a relative value when the sensitivity of each light-sensitive layer of each light-sensitive material color developed for 2 minutes in processing A is defined as 100. The sensitivity is shown by a relative value of the reciprocal of an exposure amount necessary for giving a density of the minimum density + 0.5.

The gradation shows a density difference between a sensitivity point and a point where the sensitivity is increased by 0.5 in logarithm of exposure amount (logE).

| (Processing Step) | (Temperature) | (Time) |
|---|---|---|
| Development | 38° C. | 1 to 3 min. |
| Blix | 38° C. | 1.5 min. |
| Wash | 28 to 35° C. | 3.0 min. |

| | |
|---|---|
| (Formulation of Developer) | |
| Color Developer (A): | |
| Nitrilotriacetic Acid.3Na | 2.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N—ethyl-N—[β-(methanesulfonamido)ethyl]-p-phenylenediamine.Sulfate | 5.0 g |
| $Na_2CO_3$ (monohydrate) | 30.0 g |
| Water to make | 1,000 ml (pH 10.1) |
| Color Developer (B): | |
| Nitrilotriacetic Acid.3Na | 2.0 g |
| $Na_2SO_3$ | 2.0 g |
| KBr | 0.5 g |
| Hydroxylamine Sulfate | 3.0 g |
| 4-Amino-3-methyl-N—ethyl-N—[β-(methanesulfonamido)ethyl]-p-phenylenediamine.Sulfate | 5.0 g |
| $Na_2CO_3$ (monohydrate) | 30.0 g |
| Water to make | 1,000 ml (pH 10.1) |
| (Formulation of Blix Solution) | |
| Ammonium Thiosulfate (54 wt. %) | 150 ml |
| $Na_2SO_3$ | 15 g |
| $NH_4[Fe(III)(EDTA)]$ | 55 g |
| EDTA.2Na | 4 g |
| Water to make | 1,000 ml (pH 6.9) |

TABLE 4

| Sample | Layer | Processing A Developing Time | | | | | | | | | | | | Processing B Developing Time | | | | | | | | | | | |
|---|---|---|---|---|---|---|---|---|---|---|---|---|---|---|---|---|---|---|---|---|---|---|---|---|---|
| | | 1 minute | | | | 2 minutes | | | | 3 minutes | | | | 1 minute | | | | 2 minutes | | | | 3 minutes | | | |
| | | RS | Gd | Dmax | Dmin | RS | Gd | Dmax | Dmin | RS | Gd | Dmax | Dmin | RS | Gd | Dmax | Dmin | RS | Gd | Dmax | Dmin | RS | Gd | Dmax | Dmin |
| (A) | B | 59 | 0.99 | 1.99 | 0.10 | 100 | 1.12 | 2.10 | 0.12 | 119 | 1.14 | 2.11 | 0.12 | 63 | 1.00 | 1.98 | 0.09 | 94 | 1.11 | 2.08 | 0.10 | 114 | 1.14 | 2.10 | 0.11 |
| | G | 73 | 1.21 | 2.59 | 0.10 | 100 | 1.30 | 2.68 | 0.11 | 125 | 1.34 | 2.72 | 0.12 | 81 | 1.24 | 2.59 | 0.10 | 98 | 1.28 | 2.67 | 0.11 | 122 | 1.31 | 2.72 | 0.12 |
| | R | 80 | 1.41 | 2.81 | 0.11 | 100 | 1.43 | 2.83 | 0.12 | 128 | 1.45 | 2.84 | 0.12 | 82 | 1.41 | 2.78 | 0.10 | 97 | 1.42 | 2.80 | 0.12 | 125 | 1.44 | 2.80 | 0.12 |
| (B) | B | 65 | 1.12 | 2.14 | 0.10 | 100 | 1.13 | 2.23 | 0.12 | 121 | 1.13 | 2.25 | 0.13 | 70 | 1.11 | 2.13 | 0.10 | 96 | 1.13 | 2.20 | 0.11 | 115 | 1.14 | 2.22 | 0.12 |
| | G | 75 | 1.26 | 2.57 | 0.12 | 100 | 1.31 | 2.68 | 0.12 | 124 | 1.35 | 2.73 | 0.13 | 82 | 1.22 | 2.55 | 0.11 | 99 | 1.30 | 2.67 | 0.11 | 121 | 1.34 | 2.71 | 0.12 |
| | R | 81 | 1.40 | 2.81 | 0.11 | 100 | 1.44 | 2.83 | 0.12 | 129 | 1.45 | 2.83 | 0.12 | 81 | 1.37 | 2.79 | 0.10 | 97 | 1.42 | 2.82 | 0.11 | 127 | 1.43 | 2.83 | 0.11 |
| (C) | B | 38 | 0.81 | 1.91 | 0.12 | 100 | 1.02 | 2.01 | 0.13 | 116 | 1.13 | 2.04 | 0.21 | 33 | 0.52 | 1.41 | 0.11 | 74 | 0.59 | 1.65 | 0.12 | 85 | 0.61 | 1.69 | 0.16 |
| | G | 51 | 1.19 | 2.48 | 0.11 | 100 | 1.24 | 2.52 | 0.14 | 131 | 1.26 | 2.53 | 0.19 | 40 | 0.61 | 1.75 | 0.09 | 81 | 0.74 | 1.86 | 0.13 | 92 | 0.78 | 1.89 | 0.15 |
| | R | 66 | 1.31 | 2.60 | 0.12 | 100 | 1.37 | 2.70 | 0.14 | 123 | 1.38 | 2.74 | 0.23 | 53 | 0.77 | 1.93 | 0.10 | 82 | 0.91 | 2.08 | 0.12 | 90 | 0.93 | 2.10 | 0.17 |
| (D) | B | 68 | 1.16 | 2.14 | 0.04 | 100 | 1.30 | 2.24 | 0.10 | 117 | 1.32 | 2.25 | 0.12 | 65 | 1.15 | 2.13 | 0.08 | 97 | 1.30 | 2.23 | 0.09 | 109 | 1.16 | 2.24 | 0.11 |
| | G | 77 | 1.24 | 2.70 | 0.10 | 100 | 1.27 | 3.74 | 0.10 | 129 | 1.30 | 2.75 | 0.13 | 81 | 1.24 | 2.69 | 0.09 | 99 | 1.30 | 2.74 | 0.09 | 127 | 1.33 | 2.75 | 0.11 |
| | R | 83 | 1.53 | 2.86 | 0.11 | 100 | 1.55 | 2.89 | 0.12 | 130 | 1.56 | 2.89 | 0.12 | 84 | 1.54 | 2.85 | 0.04 | 98 | 1.55 | 2.88 | 0.11 | 128 | 1.55 | 2.89 | 0.12 |

RS: Relative Sensitivity; Gd: Gradation

As is clear from the results shown in Table 4 above, when the silver halide emulsions (6) and (7) of this invention are used, good photographic properties of high sensitivity, high contrast and low Dmin, which are almost the same as those in the case of processing with processing A using benzyl alcohol, are shown even in the case of processing with processing B without containing benzyl alcohol and also sufficiently high color density is shown even in the processing of short period of time. Furthermore, even in processing B, color images having low fog and high color density with high sensitivity are obtained as compared with the case of using comparison emulsions (1), (2), and (3).

Example 2

Silver halide emulsion (8) for comparison blue-sensitive emulsion layer and silver halide emulsion (9) for comparison green-sensitive and red-sensitive emulsion layers were prepared by the same manner as the case of preparing the silver halide emulsion (6) while changing the amount of chemicals, the temperatures, and the times.

The average grain sizes, the variation coefficients, and the halogen compositions of the silver halide emulsions (6) to (9) thus prepared are shown in Table 5 below.

Also, by replacing the emulsions of the emulsion layers shown in Table 1 with the silver halide emulsions (6) to (9) described above, samples (E), (F) and (G) and (I) were prepared. These structures are shown in Table 6.

Each of the samples (E), (F) and (G) described above was exposed and processed in the same manner as in Example 1 and the photographic properties were evaluated. However, the evaluation of the photographic properties was made on the five points of the processing time for the development for 30 seconds, 45 seconds, 1 minute, 2 minutes, and 3 minutes.

The results obtained are shown in Table 7 and Table 8.

TABLE 5

| Emulsion | Average Grain Size (μm) | Variation Coefficient ($s/\bar{d}$) | Halogen Composition (%) |
|---|---|---|---|
| (6) This invention | 1.00 | 0.07 | Br = 80, Cl = 20 |
| (7) This invention | 0.53 | 0.06 | Br = 80, Cl = 20 |
| (8) Comparison | 0.95 | 0.09 | Br = 80, Cl = 18, I = 2 |
| (9) Comparison | 0.46 | 0.10 | Br = 80, Cl = 20, I = 2 |

TABLE 6

| Sample | Emulsion | | |
|---|---|---|---|
| | Blue-Sensitive Layer | Green-Sensitive Layer | Red Sensitive Layer |
| (E) | (6) This invention | (7) This invention | (7) This invention |
| (F) | (8) Comparison example | (9) Comparison example | (9) Comparison example |
| (G) | (8) Comparison example | (7) This invention | (7) This invention |

TABLE 7

| | | Processing A Developing Time | | | | | | | | | | | | | | | | | | | |
|---|---|---|---|---|---|---|---|---|---|---|---|---|---|---|---|---|---|---|---|---|---|
| | | 30 seconds | | | | 45 seconds | | | | 1 minute | | | | 2 minutes | | | | 3 minutes | | | |
| Sample | Layer | RS | Gd | Dmax | Dmin | RS | Gd | Dmax | Dmin | RS | Gd | Dmax | Dmin | RS | Gd | Dmax | Dmin | RS | Gd | Dmax | Dmin |
| | B | 22 | 0.23 | 0.82 | 0.08 | 43 | 0.63 | 1.37 | 0.08 | 68 | 1.16 | 2.14 | 0.09 | 100 | 1.30 | 2.24 | 0.10 | 117 | 1.32 | 2.25 | 0.12 |
| (E) | G | 46 | 0.80 | 1.43 | 0.09 | 68 | 1.23 | 2.22 | 0.09 | 77 | 1.24 | 2.70 | 0.10 | 100 | 1.27 | 2.74 | 0.10 | 129 | 1.30 | 2.75 | 0.13 |
| | R | 47 | 1.02 | 1.68 | 0.08 | 67 | 1.48 | 2.36 | 0.09 | 83 | 1.53 | 2.86 | 0.11 | 100 | 1.55 | 2.89 | 0.12 | 130 | 1.56 | 2.89 | 0.12 |
| | B | 7 | 0.12 | 0.71 | 0.09 | 22 | 0.49 | 1.16 | 0.10 | 47 | 0.92 | 2.11 | 0.10 | 100 | 1.05 | 2.23 | 0.11 | 113 | 1.10 | 2.29 | 0.12 |
| (F) | G | 21 | 0.52 | 1.33 | 0.09 | 42 | 0.71 | 1.84 | 0.10 | 69 | 0.87 | 2.39 | 0.11 | 100 | 0.98 | 2.48 | 0.12 | 117 | 1.01 | 2.57 | 0.13 |
| | R | 26 | 0.62 | 1.36 | 0.09 | 45 | 0.89 | 2.14 | 0.10 | 71 | 1.11 | 2.73 | 0.10 | 100 | 1.25 | 2.82 | 0.11 | 120 | 1.26 | 2.91 | 0.13 |
| | B | 6 | 0.13 | 0.72 | 0.09 | 21 | 0.50 | 1.15 | 0.10 | 49 | 0.92 | 2.12 | 0.11 | 100 | 1.04 | 2.24 | 0.12 | 115 | 1.10 | 2.30 | 0.12 |
| (G) | G | 45 | 0.81 | 1.44 | 0.09 | 68 | 1.24 | 2.23 | 0.09 | 78 | 1.24 | 2.71 | 0.10 | 100 | 1.28 | 2.74 | 0.13 | 128 | 1.31 | 2.74 | 0.13 |
| | R | 46 | 1.03 | 1.69 | 0.08 | 67 | 1.47 | 2.35 | 0.09 | 85 | 1.53 | 2.86 | 0.11 | 100 | 1.55 | 2.90 | 0.12 | 130 | 1.56 | 2.88 | 0.13 |

RS: Relative Sensitivity; Gd: Gradation

TABLE 8

| | | Processing B Developing Time | | | | | | | | | | | | | | | | | | | |
|---|---|---|---|---|---|---|---|---|---|---|---|---|---|---|---|---|---|---|---|---|---|
| | | 30 seconds | | | | 45 seconds | | | | 1 minute | | | | 2 minutes | | | | 3 minutes | | | |
| Sample | Layer | RS | Gd | Dmax | Dmin | RS | Gd | Dmax | Dmin | RS | Gd | Dmax | Dmin | RS | Gd | Dmax | Dmin | RS | Gd | Dmax | Dmin |
| | B | 19 | 0.20 | 0.78 | 0.08 | 38 | 0.63 | 1.30 | 0.08 | 65 | 1.15 | 2.13 | 0.08 | 97 | 1.30 | 2.23 | 0.09 | 109 | 1.16 | 2.24 | 0.11 |
| (E) | G | 44 | 0.73 | 1.37 | 0.08 | 66 | 1.17 | 2.20 | 0.09 | 81 | 1.24 | 2.69 | 0.09 | 99 | 1.26 | 2.74 | 0.09 | 127 | 1.25 | 2.75 | 0.11 |
| | R | 39 | 0.94 | 1.58 | 0.09 | 65 | 1.43 | 2.31 | 0.09 | 84 | 1.54 | 2.85 | 0.09 | 98 | 1.55 | 2.88 | 0.11 | 128 | 1.55 | 2.89 | 0.12 |
| | B | *— | *— | 0.42 | 0.08 | 11 | 0.21 | 1.32 | 0.09 | 34 | 0.49 | 1.33 | 0.09 | 68 | 0.57 | 1.46 | 0.11 | 81 | 0.59 | 1.51 | 0.11 |
| (F) | G | 8 | 0.21 | 0.81 | 0.09 | 24 | 0.51 | 1.33 | 0.10 | 52 | 0.68 | 1.76 | 0.10 | 79 | 0.76 | 1.84 | 0.12 | 91 | 0.78 | 1.93 | 0.12 |
| | R | 12 | 0.29 | 0.89 | 0.08 | 32 | 0.65 | 1.43 | 0.09 | 64 | 0.83 | 1.93 | 0.10 | 81 | 0.95 | 2.01 | 0.11 | 93 | 0.98 | 2.10 | 0.13 |
| | B | *— | *— | 0.41 | 0.08 | 11 | 0.20 | 1.33 | 0.09 | 33 | 0.48 | 1.33 | 0.10 | 69 | 0.58 | 1.47 | 0.11 | 80 | 0.59 | 1.52 | 0.12 |
| (G) | G | 44 | 0.72 | 1.38 | 0.08 | 65 | 1.16 | 2.20 | 0.08 | 80 | 1.23 | 2.70 | 0.09 | 98 | 1.24 | 2.74 | 0.11 | 127 | 1.24 | 2.75 | 0.12 |
| | R | 40 | 0.95 | 1.57 | 0.08 | 64 | 1.42 | 2.30 | 0.09 | 84 | 1.54 | 2.85 | 0.10 | 98 | 1.56 | 2.87 | 0.10 | 126 | 1.56 | 2.89 | 0.12 |

(*): Sensitivity is not shown since Dmax does not reach for density + 0.5.
RS: Relative Sensitivity; Gd: Gradation As is clear from the results shown in Tables 7 and 8 above, when the silver halide emulsions (6) and (7) of this invention are used, good photographic performance, which is almost the same as the case of processing with processing A using benzyl alcohol, is shown even in the case of processing with processing B without containing benzyl alcohol and also sufficiently high color density is obtained even in the processing of a shortened processing time. On the other hand, in the case of using comparison silver halide emulsions (8) and (9), such disadvantages that the color density is insufficient even when the emulsion is a monodispersed silver halide emulsion and Dmin becomes high are shown.

INDUSTRIAL UTILIZABILITY

By the practice of this invention, by substantially containing no benzyl alcohol the load for pollution can be reduced, the load for working of preparing the developer can be reduced, and the effect of preventing the occurrence of reduction in density by cyan dyes which remain as leuco compounds can be obtained. Also, the use of the silver halide emulsions in this invention gives the effect of obtaining photographic properties having high Dmax, low Dmin, and showing less change of sensitivity and gradation even when benzyl alcohol is not used.

What is claimed is:

1. A color image-forming process which comprises developing, after imagewise exposure, a color photographic light-sensitive material comprising a reflective support having provided thereon at least one silver halide emulsion layer containing a core/shell surface latent image type monodispersed silver halide emulsion (having a variation coefficient of up to 0.15) containing no silver iodide, having a silver chloride content of up to 80 mol%, and having a silver bromide content in the shell portion lower than that in the core portion with a color developer containing substantially no benzyl alcohol within 2 minutes and 30 seconds.

2. The color image-forming process as claimed in claim 1, wherein the average grain size of the core/shell surface latent image type monodispersed silver halide emulsion is from 0.1 μm to 2 μm expressed as the diameter of an equivalent circle by projection, and the grain size distribution of the emulsion is up to 0.10 in $s/\bar{d}$ (wherein, s is the statistical standard deviation and $\bar{d}$ is the average grain size).

3. The color image-forming process as claimed in claim 1 or 2, wherein the core/shell surface latent image type monodispersed silver halide emulsion is a silver chlorobromide emulsion containing from 2 to 80 mol% of silver chloride.

4. The color image-forming process as claimed in claim 3, wherein the content of silver chloride is from 2 to 50 mol%.

5. The color image-forming process as claimed in claim 1, wherein the color developer is an alkaline aqueous solution containing an aromatic primary amine color developing agent as the main component.

6. The color image-forming process as claimed in claim 1, which comprises, after imagewise exposure, subjecting a color photographic light-sensitive material comprising a reflective support having provided thereon at least one blue-sensitive silver halide emulsion layer, at least one green-sensitive silver halide emulsion layer, and at least one red-sensitive silver halide emulsion layer to color development, bleach and fix or blix, and wash and/or stabilization, wherein at least one of said silver halide emulsion layers contains a core/shell surface latent image type silver halide emulsion containing no silver iodide, having a silver bromide content of up to 80 mol%, and having a silver bromide content in the shell portion lower than that in the core portion and wherein said color development is carried out using a color developer containing substantially no benzyl alcohol within 2 minutes and 30 seconds.

7. The color image-forming process as claimed in claim 6, wherein the average grain size of the core/shell surface latent image type monodispersed silver halide emulsion is from 0.1 μm to 2 μm expressed as the diameter of an equivalent circle by projection and the grain size distribution of the silver halide emulsion is up to 0.10 in $s/\bar{d}$ (wherein, s is the statistical standard deviation and $\bar{d}$ is the average grain size).

8. The color image-forming process as claimed in claim 6 or 7, wherein the core/shell surface latent image type monodispersed silver halide emulsion is a silver chlorobromide emulsion containing from 2 to 80 mol% of silver chloride.

9. The color image-forming process as claimed in claim 8, wherein the content of silver chloride is from 2 to 50 mol%.

10. The color image-forming process as claimed in claim 6, wherein the color developer is an alkaline aqueous solution containing an aromatic primary amine color developing agent as the main component.

11. The color image-forming process as claimed in claim 1, wherein the silver bromide content in the core portion of the core/shell surface latent image type monodispersed silver halide emulsion is at least 10 mol% higher than that in the shell portion thereof.

12. The color image-forming process as claimed in claim 1, wherein the silver bromide content in the core portion of the core/shell surface latent image type monodispersed silver halide emulsion is at least 15 mol% higher than that in the shell portion thereof.

13. The color image-forming process as claimed in claim 1, wherein the silver bromide content in the core portion of the core/shell surface latent image type monodispersed silver halide emulsion is at least 20% higher than that in the shell portion thereof.

14. The color image-forming process as claimed in claim 1, wherein the silver halide forms latent images mainly on the surface of the grains.

15. The color image-forming process as claimed in claim 1, wherein the color developer contains no benzyl alcohol.

16. The color image-forming process as claimed in claim 5 or 10, wherein the aromatic primary amine developing agent is a p-phenylenediamine compound.

17. The color image-forming process as claimed in claim 16, wherein the p-phenylenediamine compound is 3-methyl-4-amino-N-ethyl-N-β-methanesulfonamidoethylaniline or 3-methyl-4-amino-N-ethyl-N-hydroxyethylaniline.

18. The color image-forming process as claimed in claim 16, wherein the p-phenylenediamine-series compound is 3-methyl-4-amino-N-ethyl-N-β-methanesulfonamidoethylaniline.

* * * * *